United States Patent [19]

Keppeler

[11] Patent Number: 4,775,066

[45] Date of Patent: Oct. 4, 1988

[54] IN GROUND TRASH RECEPTACLE

[76] Inventor: K. Eugen Keppeler, 6604 Ferguson Rd., Clay, N.Y. 13041

[21] Appl. No.: 118,968

[22] Filed: Nov. 12, 1987

[51] Int. Cl.[4] ..... B65D 25/18; B65D 25/38

[52] U.S. Cl. ..... 220/1 T; 220/18; 220/20

[58] Field of Search ..... 220/1 T, 18, 20

[56] References Cited

U.S. PATENT DOCUMENTS 4,570,812 2/1986 Curtis ..... 220/1 T 4,628,827 12/1986 Litter ..... 220/18

*Primary Examiner*—George T. Hall

*Attorney, Agent, or Firm*—Wall and Roehrig

[57] ABSTRACT

An outdoor receptacle for temporarily storing disposable and reclaimable trash at a collection site prior to the trash being picked up. The receptacle includes a rectangular open top container that is partially buried in the ground and which has a cover hinged thereon that closes over the vertical side walls of the container to provide a weather tight structure. An outwardly extended ground rail is secured to the outside of the container that is at about ground level. An anchor is secured to the bottom wall of the container which acts in concert with the ground rail to stabilize the container in the ground. The interior of the container is compartmentized to segregate disposable and reclaimable waste products. The cover is normally locked to the container in a closed condition so that it can only be opened by the user and the trash collector.

7 Claims, 2 Drawing Sheets

IN GROUND TRASH RECEPTACLE

BACKGROUND OF THE INVENTION

This invention relates to an outdoor trash receptacle that is partially buried in the ground at a collection site and which has a lock to prevent unauthorized access to the receptacle.

As evidenced by U.S. Pat. Nos. 3,407,941 and 1,550,043, garbage receptacles have been devised for storing trash in outdoor areas while awaiting collection. For the most part, these devices are unsightly and can be opened by animals and humans. Furthermore, these containers are typically top heavy and thus easily tipped over by high winds or vandals, thereby scattering the contents about the neighborhood. In addition, the containers are generally poorly fabricated and susceptible to damage. Lastly, little or no provision is made for cleaning and sanitizing the container and, as a consequence, they can become contaminated after being used only a short time. Contaminated containers not only smell bad but also breed germs and insects.

In recent years more and more communities have turned to segregating refuse into reclaimable solid waste products and disposable waste. Solid waste generally includes cans, bottles and newsprint, while disposable products include, for the most part, burnable trash having no reclaimable value. U.S. Pat. No. 4,682,699 to Ertley describes the problems faced by the average household in managing this type of segregatable waste. A waste recycling system is disclosed wherein the various types of trash are segregated into individual bins in the home or garage. When the bins are filled, they are brought to the curb and inserted into an in-ground container which is fully buried in the ground except for its removable lid. In one embodiment, trash is stored in the container in paper bags. In another embodiment, removable trash cans containing segregated trash are stored in the container.

There is a high probability that paper bags will break within an in-ground container, particular when wet garbage is placed in the bags. Cleaning wet garbage from the interior of the Ertley container is extremely difficult because water collected in the container generally has no way of escaping. The container, furthermore, is not vented to atmosphere so that moisture collected in the container can not be dissipated into the surrounding ambient. By the same token, unpleasant odors associated with collected trash will buildup in the container and thus tend to pollute the surrounding neighborhood when the cover is removed. The cover is not secured to the container and thus can be opened by anyone. This creates an attractive nuisance and a potential hazard in that people and animals can fall into a container that is left open. This risk is especially high in the case of young children.

Edgerton in U.S. Pat. No. 950,097 also discloses an in-ground refuge storage system in which a conventional cylindrical trash can is inserted into an in-ground shell. This receptacle suffers from the same disadvantages found in Ertley in that the container is difficult to clean, has an unsecured lid which can be opened by anyone and thus pose a danger to both the health and physical well-being to those in the neighborhood.

SUMMARY OF THE INVENTION

It is an object of the present invention to improve trash storage systems.

It is a further object of the prevent invention to provide an in-ground curb-side receptacle that has a heavy duty cover that can be secured against unauthorized opening.

Another object of the present invention is to provide an in-ground refuse receptacle that contains individual compartments for segregating reclaimable solid waste products from disposable trash.

Yet a further object of the present invention is to provide an in-ground trash receptacle that can be washed down and drained without having to remove the receptacle from the ground.

Yet another object of the present invention is to provide an attractive in-ground trash receptacle that is weather proof and which is continually vented to atmosphere to avoid the building up of objectionable odors within the receptacle.

Still another object of the present invention is to provide a tamper proof in-ground trash receptacle that has a anchoring system which prevents the receptacle from shifting its position once it is set in the ground.

These and other objects of the present invention are attained by means of an outdoor trash receptacle having a vertical walled container that is partially buried in the ground and which includes a cover hinged to the container so that it can be closed and locked to provide a tamper proof and weather proof structure. An outwardly extended ground rail surrounds the container that is adapted to be covered by soil. The ground rail cooperates with a pair of anchors secured to the bottom wall of the container to secure and stabilize the receptacle within the ground. A drain system is located in the bottom of the container which allows the interior of the container to be thoroughly and easily cleaned with water or a liquid disinfectant. An above ground air vent system is also provided which permits ambient air to circulate through the container to carry away unwanted moisture and odors. The interior of the container is partitioned to segregate reclaimable solid waste products from other trash stored therein.

BRIEF DESCRIPTION OF THE DRAWINGS

For a better understanding of these and other objects of the present invention, reference is made to the following detailed description of the invention, which is to be read in conjunction with the accompanying drawings, wherein.

DESCRIPTION OF THE INVENTION

Figure 1:
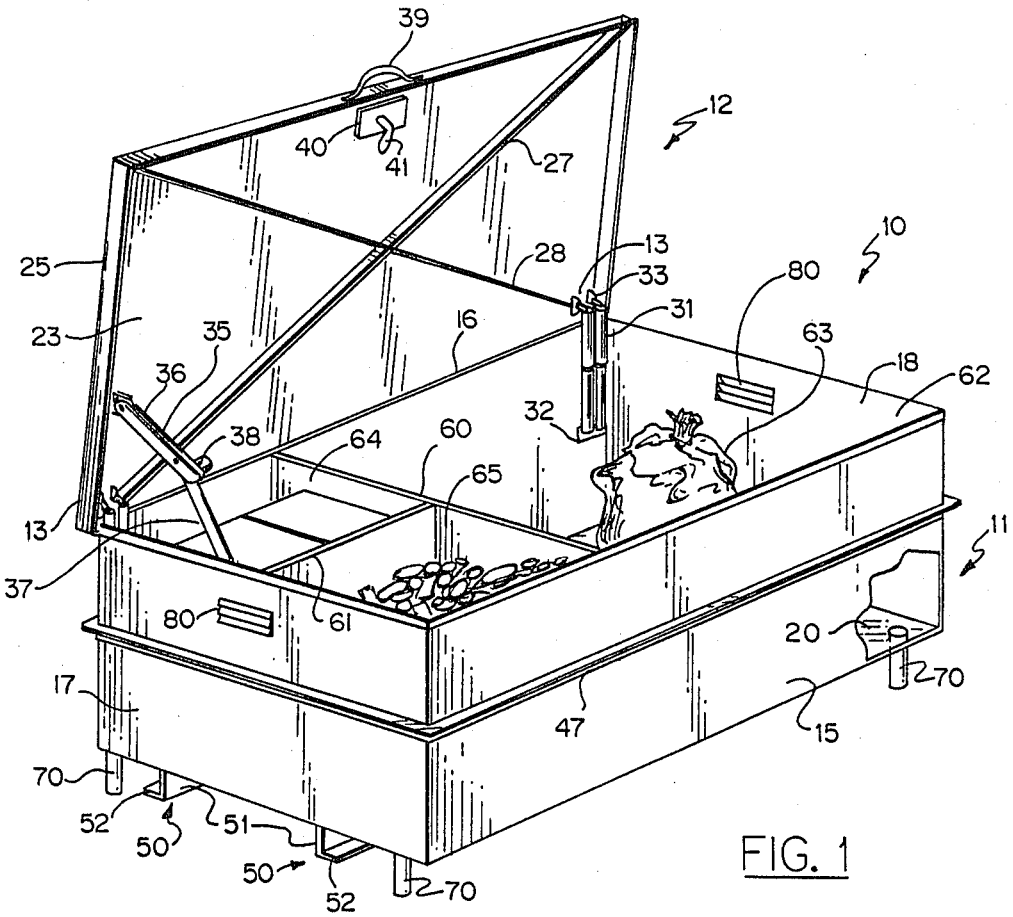
FIG. 1 is a perspective view of an outdoor trash receptacle embodying the teachings of the present invention.
Figure 2:
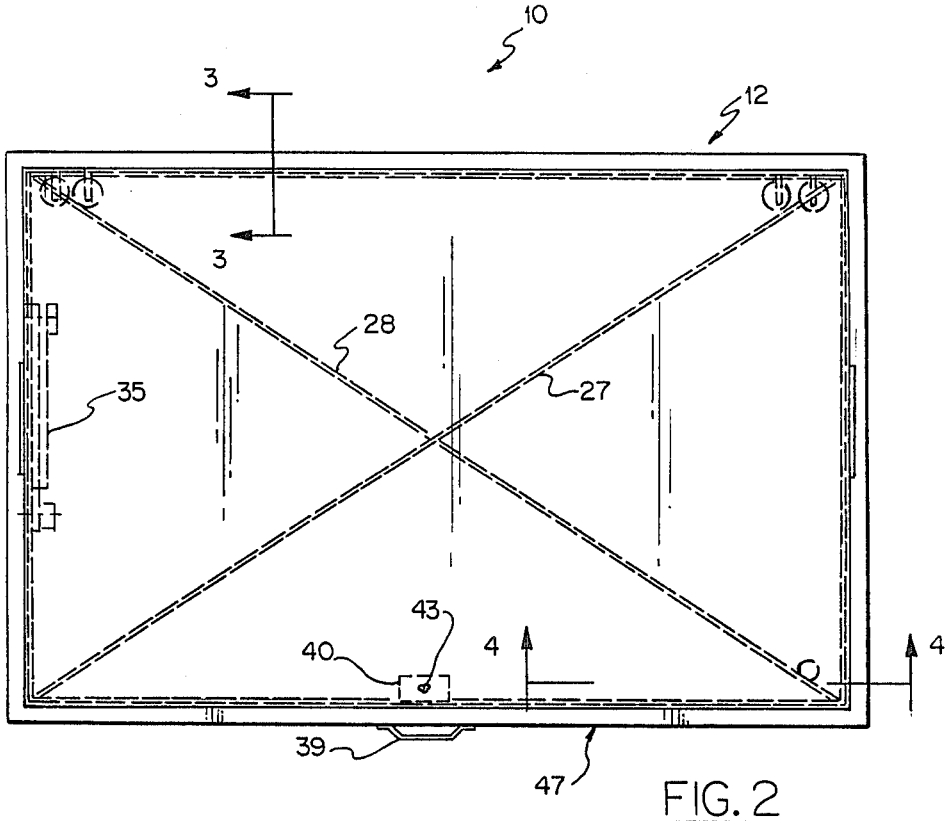
FIG. 2 is a top plan view of the receptacle shown in FIG. 1.

Referring now to the drawings, and especially FIGS. 1 and 2, there is shown an outdoor trash receptacle, generally referenced as 10, for temporarily storing both reclaimable solid waste materials and disposable materials that can be burned or safely buried in a land fill. The receptacle includes a rectangular shaped container 11 having a cover 12 mounted thereon by means of a pair of heavy duty hinges 13—13. Preferably both the container and the cover are fabricated from heavy gauge metal plate to provide for a high strength, corrosion resistant unit. It is however contemplated that other materials having suitable properties, such as high strength plastics, can be similarly employed.

The container 11 has vertically disposed front and back walls, 15 and 16 respectively, and a pair of opposed vertical end walls 17 and 18. The vertical walls are joined together at the corners and to a flat horizontal bottom wall 20 to produce a leak-tight, open topped structure capable of storing a quantity of trash. Cover 12 is hinged to the back wall of the container and includes a top wall 23, and a downwardly depending skirt 25 surrounding the periphery of the top wall. The skirt is arranged to close over the top of the vertical walls of the container when the cover is closed to provide a weather proof closure capable of protecting the interior of the container from rain, snow and the like. A pair of diagonal reinforcing bars 27 and 28 are welded to the inside of the cover to provide additional support and strength to the structure.

The cover is a relatively heavy structure that cannot be easily opened and closed without assistance. A pair of spring loaded lifting shocks 31-31 are mounted side by side in a bracket 32 welded to the back wall of the container. The other end of each lifting shock is similarly attached to the cover by means of a second bracket 33. The lifting shocks each contain a spring that is loaded in compression when the cover is closed against the container. Upon the cover being raised, the compression spring unloads to help raise the cover to an open position under controlled conditions. The shock absorbers serve to resist the weight of the cover as it moves downwardly toward a closed position to control the velocity of the cover as it is being closed. A releasable holding arm 35 extends between the cover and end wall 17. The holding arm contains two coacting links 37 and 38 that fall into alignment when the cover is fully opened to rigidly support the cover in the opened position. Pulling up on tab 38 moves the links out of alignment and permits the cover to fall back to a closed position. As noted, the spring loaded shocks dampen the downward movement of the cover and guide the cover safely into a closed position against the container. A handle 39 is welded to the skirt of the cover to help facilitate opening and closing of the lid.

The cover is equipped with a lock assembly that is generally referenced 40. The lock has a locking arm 41 that is arranged to engage a clasp (not shown) on the inside of the front wall 15 to secure the cover against the container. The lock can be opened by a master key insertable into the lock opening 43 (FIG. 2). The user of the receptacle and the trash collector each have a master key to open the cover. Once locked, the container cannot be readily opened, particularly by children or vandals. The key actuated lock can be replaced by a simple combination lock or the like without jeopardizing security or departing from the teachings of the present invention.

Figure 3:
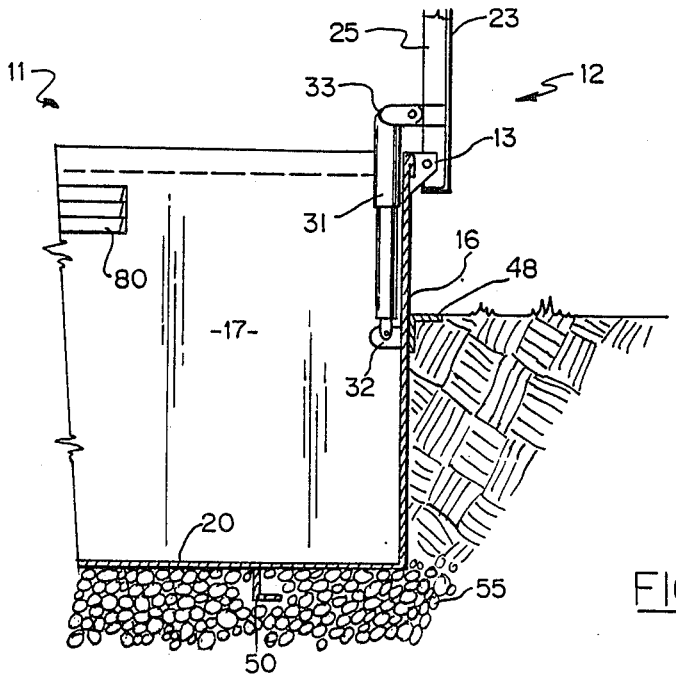
FIG. 3 is a partial sectional view taken along lines 3—3 in FIG. 2 showing the receptacle cover in a raised position.
Figure 4:
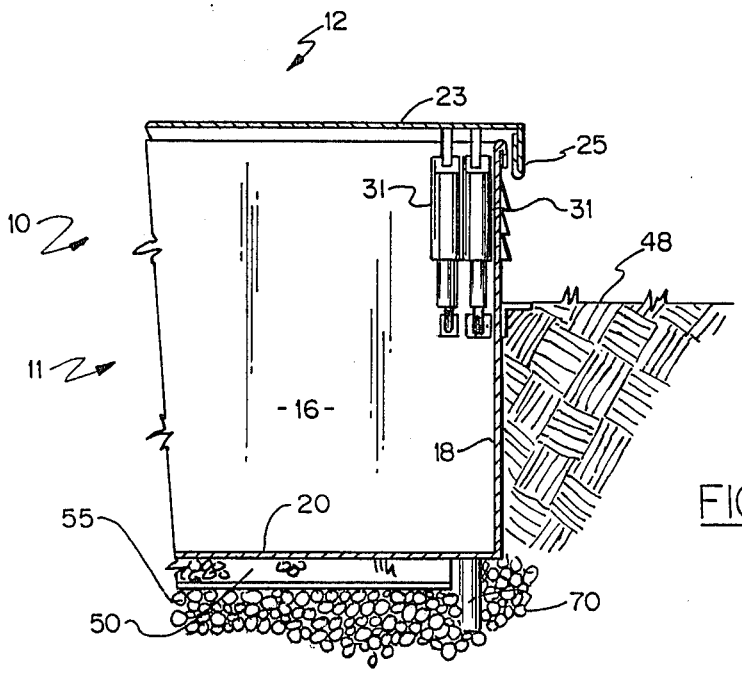
FIG. 4 is a partial sectional view taken along lines 4—4 in FIG. 2 showing the receptacle cover in a closed position.

As best illustrated in FIGS. 3 and 4, the container, in practice, is partially buried in the ground at a convenient collection site which can be at curb-side in a typical residential area. The vertical walls of the container are surrounded by a horizontally extended ground rail 47 that is welded around the outer surfaces of the walls. The ground rail is preferably formed of angle iron, which provides added strength to the container structure. The horizontal leg 48 of the ground rail is intended to be positioned just beneath the soil at ground level and thus stabilizes the container in the ground, particularly during wet or freezing weather. The container is coated with tar or a similar protective coating over all outer surfaces below the ground rail to protect the container from ground moisture.

A pair of anchor members 50—50 are also welded to the outside of the bottom wall 20 of the container. Each anchor member has a vertical leg 51 attached to the container by any suitable means and a outwardly turned horizontal leg 52. The container, as shown in FIGS. 3 and 4, is set upon a deep gravel bed 55 which lines the bottom of the ground opening in which the container is seated. The anchor members are sunk well into the gravel bed and serve along with the ground rail 47 to hold the container in a stable position in the ground and to prevent the receptacle from being easily pulled out of the ground.

The interior of the container is separated by partitioning walls 60 and 61 into individual compartments. Disposable waste is stored in sealed plastic garbage bags 63 within a large compartment 62. Alternatively, disposable trash can be stored in individual cans that are specifically designed for maximum utilization of the compartment space. A second smaller compartment 64 is used to store bundled magazines and newsprint. The last compartment 65 is shown being used to store bottles and cans.

A series of drains 70—70 are mounted in the bottom wall of the container with one drain preferably being situated in each of the compartments. The drains are formed of corrosion resistant cylinders that pass through the floor of the container into the gravel bed. The drains are adapted to conduct water, moisture and small bits of debris out of the container and into the gravel bed. Accordingly, the container can be thoroughly hosed out when required to keep it in a clean and sanitary condition.

Louvered air vents 80—80 are formed in the two end walls 17 and 18 of the container above the ground rail 47. The opposed vents are situated well above ground and are designed to permit air to move through the receptacle to dry out the interior of the container and carry off odors. The louvers are turned downwardly to prevent rain and the like from penetrating the container.

As should now be evident from the disclosure above, the apparatus of the present invention provides an aesthetically pleasing receptacle for temporarily storing reclaimable solid waste and disposable garbage. The container, which is partially buried in the earth, is both sanitary and safe to use. It can be easily cleaned in the event of unwanted spillage and any moisture or water that might collect in the container is quickly drained into the soil beneath the container.

While this invention has been explained with reference to the structure disclosed herein, it is not confined to the details set forth and this application is intended to cover any modifications and changes as may come within the scope of the following claims.

I claim:

1. An outdoor trash receptacle that is partially buried in soil for temporarily storing disposable and reclaimable waste prior to collection that includes, a rectangular shaped, open topped container having vertically disposed back, front and end walls and a horizontally disposed bottom wall, an outwardly extended ground rail surrounding the vertical walls of said container at about ground level, a top cover hinged to the back wall of the container having a downwardly turned skirt about its periphery that closes over the vertical walls of the container to provide a weather tight closure therewith, anchor means downwardly disposed from the bottom wall of the container for securing the container in the soil, partition means for dividing the interior of the container into a plurality of compartments for separating disposable waste products from reclaimable solid waste products, and locking means for releasably securing the cover to the container.

2. The receptacle of claim 1 that further includes a venting means mounted in at least one of the vertical walls above said gound rail for venting the interior of the container to atmosphere.

3. The receptacle of claim 2 that further includes a drain means passing through the bottom wall of the container for conducting water from the interior of the container into the soil beneath the container.

4. The receptacle of claim 1 that further includes a spring loaded, shock absorbing means arranged to act between the container and the cover for assisting in opening and closing of said cover.

5. The receptacle of claim 4 that further includes a releasable holding arm mounted between the cover and the container for holding the cover in a fully opened position.

6. The receptacle of claim 1 that further includes a moisture resistant coating over the outer surfaces of the container below the ground rail.

7. The receptacle of claim 1 wherein said partition means separates the interior of the container in a first paper storage compartment, a second can or bottle storage compartment and a third garbage storage compartment.

* * * * *